US010711532B2

(12) United States Patent
Konschuh

(10) Patent No.: US 10,711,532 B2
(45) Date of Patent: Jul. 14, 2020

(54) PROTECTION OF DOWNHOLE COMPONENTS FROM SHOCK AND VIBRATION

(71) Applicant: STAG ENERGY SOLUTIONS INC., Calgary (CA)

(72) Inventor: Christopher W. Konschuh, Calgary (CA)

(73) Assignee: STAG ENERGY SOLUTIONS INC., Calgary, Alberta (CA)

( * ) Notice: Subject to any disclaimer, the term of this patent is extended or adjusted under 35 U.S.C. 154(b) by 276 days.

(21) Appl. No.: 15/826,029

(22) Filed: Nov. 29, 2017

(65) Prior Publication Data

US 2018/0179830 A1 Jun. 28, 2018

Related U.S. Application Data

(60) Provisional application No. 62/433,028, filed on Dec. 12, 2016.

(30) Foreign Application Priority Data

Nov. 27, 2017 (CA) ..... 2986998

(51) Int. Cl.
*E21B 17/07* (2006.01)

(52) U.S. Cl.
CPC ..... *E21B 17/07* (2013.01)

(58) Field of Classification Search
CPC ..... E21B 17/07; E21B 47/011; E21B 17/02; E21B 17/073; E21B 44/005
See application file for complete search history.

(56) References Cited

U.S. PATENT DOCUMENTS 3,323,326 A * 6/1967 Vertson ..... E21B 17/07 464/20
4,901,806 A * 2/1990 Forrest ..... E21B 17/073 175/321

(Continued)

FOREIGN PATENT DOCUMENTS

CA 2735619 A1 9/2012
CN 202082328 U 12/2011

(Continued)

OTHER PUBLICATIONS

Snubbers NRC Information Research Report, submitted Jul. 21, 2016 (5 pages).

(Continued)

*Primary Examiner* — Daniel P Stephenson
(74) *Attorney, Agent, or Firm* — Mintz Levin Cohn Ferris Glovsky and Popeo, P.C.

(57) ABSTRACT

A device, such as a snubber or shock absorber, for mitigating shock and vibration in downhole tools is provided. The device can have a body and an insert, which are separated by an elastomer to inhibit direct metal-to-metal contact therebetween. The insert has a projecting portion located within a cavity of the body. The elastomer is disposed within a gap between the insert and the internal surface walls of the cavity, and the elastomer surrounds and contacts the projecting portion and the walls. The elastomer may be molded, for example by flowing it into the cavity and subsequent hardening. Injection holes may be provided for molding. The projecting portion may be shaped to limit rotation upon failure of the elastomer and/or may include ribs and splines for shock absorption. The body may include a cap that contains the projecting portion to inhibit pull-apart.

25 Claims, 13 Drawing Sheets

(56) References Cited

U.S. PATENT DOCUMENTS

| | | | | |
|---|---|---|---|---|
| 4,936,394 | A | 6/1990 | Ohtsu | |
| 5,833,541 | A | 11/1998 | Turner et al. | |
| 6,916,248 | B1 * | 7/2005 | Burgess | E21B 17/02 464/20 |
| 7,044,219 | B2 * | 5/2006 | Mason | E21B 17/07 166/242.1 |
| 7,555,210 | B2 | 6/2009 | Calvet | |
| 8,640,795 | B2 | 2/2014 | Jekielek | |
| 8,785,507 | B2 | 7/2014 | Bloomfield | |
| 8,978,817 | B2 | 3/2015 | Rodgers et al. | |
| 9,102,799 | B2 | 8/2015 | Bloomfield | |
| 9,187,997 | B2 * | 11/2015 | Cramer | E21B 47/011 |
| 2006/0201684 | A1 | 9/2006 | Boscher et al. | |
| 2006/0202400 | A1 | 9/2006 | Fitzgerald | |
| 2007/0153629 | A1 | 7/2007 | Drumheller et al. | |
| 2012/0247832 | A1 | 10/2012 | Cramer et al. | |
| 2013/0206395 | A1 | 8/2013 | Cramer | |
| 2014/0262339 | A1 | 9/2014 | Nero et al. | |
| 2016/0215609 | A1 | 7/2016 | Miller | |
| 2018/0179830 | A1 * | 6/2018 | Konschuh | E21B 17/07 |

FOREIGN PATENT DOCUMENTS

| | | | |
|---|---|---|---|
| EP | 1977073 | B1 | 6/2011 |
| EP | 2545103 | B1 | 1/2013 |
| EP | 2775093 | A1 | 9/2014 |
| WO | 2004097246 | A1 | 11/2004 |
| WO | 2011112699 | A1 | 9/2011 |

OTHER PUBLICATIONS

General Downhole Air Ride MWD Suspension Brochure, retrieved Jan. 2014 (1 page).
Lord Isolators for DownholeTools Brochure, 2014 (2 pages).
Compass Directional Guidance, Inc., Vibration Dampener, 2013 (3 pages).
General Downhole Vibe Brochure, retrieved Nov. 1, 2013 (2 pages).

* cited by examiner

SECTION A-A

SECTION B-B

SECTION A-A

PROTECTION OF DOWNHOLE COMPONENTS FROM SHOCK AND VIBRATION

CROSS REFERENCE TO RELATED APPLICATIONS

The application claims the benefit of priority to U.S. Provisional Patent Application Ser. No. 62/433,028 filed on Dec. 12, 2016, and entitled Protection of Downhole Components From Shock And Vibration, the contents of which are incorporated by reference.

FIELD

The present invention pertains to the field of the protection of downhole components, such as measurement while drilling (MWD) equipment, from shock and vibration while drilling.

BACKGROUND

Some oil and gas exploration and production companies use vibrating devices known as agitators to increase penetration rates while drilling wells; agitators provide additional shock and vibration throughout the drill string to improve drilling performance. However, these devices can cause damage to or the failure of the downhole components, such as the sensitive electronic components contained within MWD systems.

Shock absorbing systems, such as snubbers, have been added to drill strings to better protect MWD systems. Such systems can be used to counter shock and vibrations, for example occurring due to the use of agitators, in order to better protect sensitive downhole components such as electronic MWD devices.

However, existing shock absorbing systems can be overly complex, and/or limited in their reliability or performance. Design challenges exist due to the need for such systems to continue to operate reliably in extreme temperature conditions for potentially prolonged periods.

Therefore, there is a need for a method and apparatus for protecting downhole components from shock and vibration that is not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

In accordance with embodiments, there is provided herein methods and apparatuses for protecting downhole components from shock and vibration. According to one embodiment, there is provided a device for mitigating shock and vibration in downhole tools. The device includes a body with a cavity and an insert that has a first part located within the cavity and a second part located outside the cavity. The insert can be spaced apart from the internal surface of the body to define a gap there between, and an elastomer can be disposed within said gap such that the elastomer surrounds and contacts the first part of the insert and the internal surface walls of the body defining the cavity and is configured to inhibit direct metal-to-metal contact between the body and the insert.

In accordance with another embodiment, the insert can include a projecting portion and a shaft connected with the projecting portion, and the first part of the insert can correspond to the projecting portion and a first portion of the shaft.

In accordance with another embodiment, the first part of the insert can correspond to a projecting portion including a first sub-portion having splines oriented along the longitudinal axis of the at least a portion of the projecting portion. The splines can be aligned with corresponding longitudinal grooves formed in the internal surface walls of the body defining the cavity, and the elastomer can be disposed between the splines and the corresponding longitudinal grooves for absorbing torsional shock and/or vibration.

The projecting portion can also include a second sub-portion that has ribs oriented circumferentially around the projecting portion. The ribs can be aligned with corresponding circumferential grooves formed in the internal surface walls of the body with the elastomer disposed between the ribs and the corresponding circumferential grooves for absorbing axial shock and/or vibration.

In accordance with another embodiment, the device can include a second shock absorbing assembly having a housing connected with the body and at least one compression spring within the housing and surrounding a mandrel located in the housing.

The second shock absorbing assembly can include a nut threaded on the mandrel to separate the housing into a first cavity and a second cavity. In another example, a first compression spring can be located in the first cavity, and a second compression spring can be located in the second cavity.

The device may be provided as a snubber or a shock absorber. The elastomer may be molded within the gap, for example by flowing the elastomer in a fluid form into the cavity and hardening the elastomer in the gap. Various configurations of the projecting portion and other features are described herein.

BRIEF DESCRIPTION OF THE FIGURES

Further features and advantages will become apparent from the following detailed description, taken in combination with the appended drawings, in which.

DETAILED DESCRIPTION

Figure 1A:
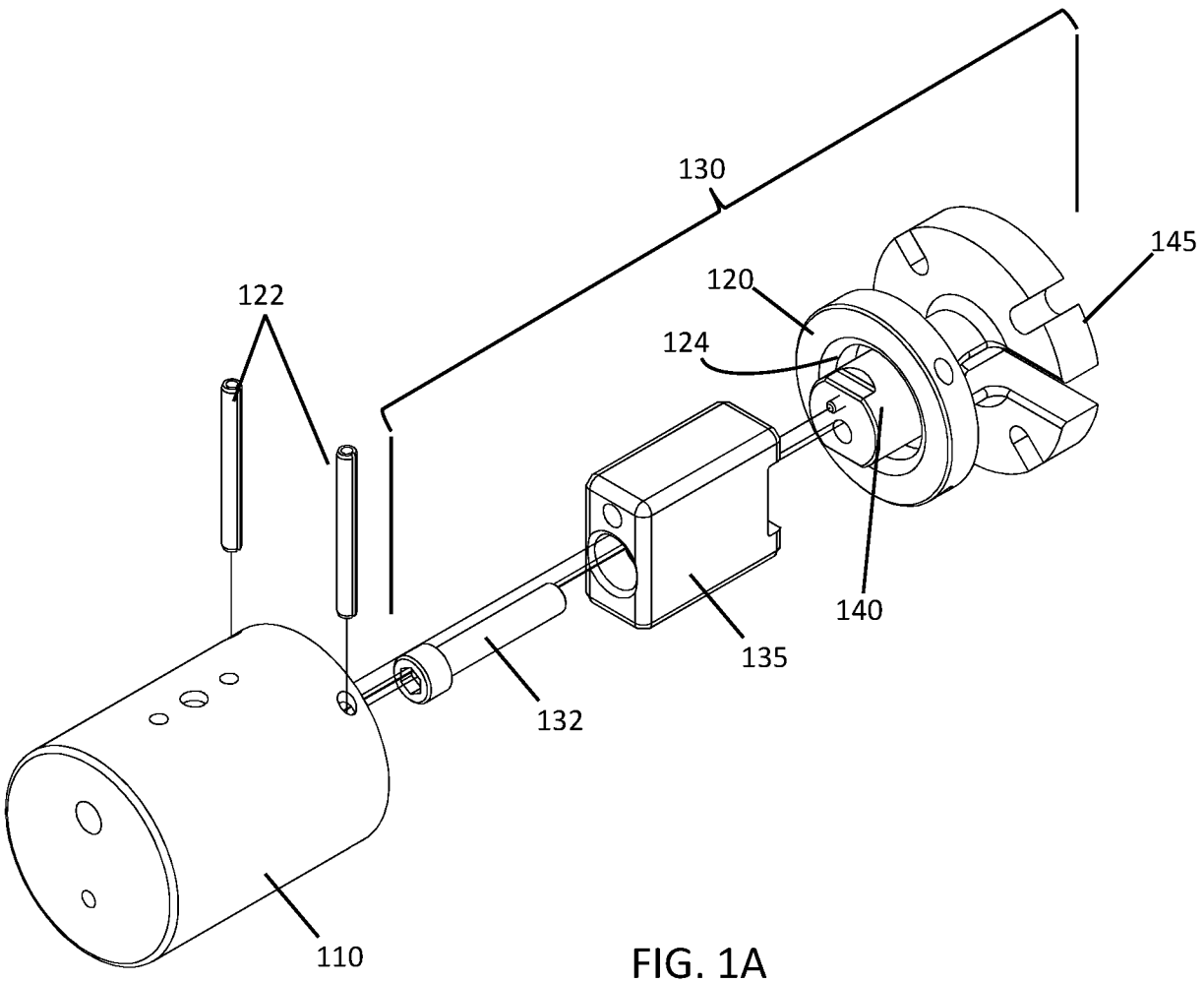
FIGS. 1A and 1B illustrate, from different perspectives, an exploded view of a snubber provided in accordance with an embodiment of the present invention.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various embodiments are provided herein for a device for mitigating shock and vibration in downhole tools, such as a snubber or a shock absorber. The device generally can include two rigid (e.g. metallic) portions—namely a body and an insert. The body can include a cavity, and the insert can include a first part that is located within the cavity and a second part that is located outside of the cavity. The insert may also include a shaft that is partially located within the cavity. The first part of the insert according to one embodiment may include the projecting portion and a first portion of the shaft. The second part may include the remaining portion of the shaft. A first end of the shaft can couple to the projecting portion and a second end of the shaft can be external to the cavity and may be used to attach to a mounting portion of the insert, which is also external to the cavity. The insert can be spaced apart from the internal surface of the body to define a gap therebetween. An elastomer can be disposed within the gap, such that the elastomer surrounds and contacts the projecting portion, the first portion of the shaft, and the internal surface walls of the body defining the cavity. The elastomer inhibits direct metal-to-metal contact between the body and the insert, while providing a solid, compliant connection between same.

Embodiments are provided herein for a downhole tool assembly including one or more devices for mitigating shock and vibration as described herein. Embodiments provide for a measurement while drilling (MWD) assembly including at least one snubber as described herein, and/or at least one shock absorber as described herein. The snubbers are contained within sondes of the MWD assembly, whereas the shock absorbers are contained within the MWD assembly.

Snubber

Embodiments can provide for a snubber. The snubber is a mechanical device designed to mitigate damage to circuit boards and sensors contained within a MWD (Measurement While Drilling) tool string. The damage is potentially caused by shock and vibration, which is produced during the process of drilling a well. In various embodiments, the snubber can be configured to be coupled to an electronic device or sensor within a sonde of a measurement while drilling (MWD) assembly of a downhole tool.

The use of a compliant and flexible material, integral to the design of the snubber, acts by breaking up and significantly diminishing potentially detrimental percussions generated due to drilling activity. For example, such percussions may be due to the interaction of a BHA (Bottom Hole Assembly) with a formation being drilled. Understanding that shock and vibration transmits easily through metal parts, a region of compliant material is provided so as to create a "break" in the snubber assembly that inhibits the transmission of shock and vibration. The snubber is designed so that no metal-to-metal contact between parts occurs across this break. In addition, the break is fully captured and this portion of the snubber is designed so as to resist being mechanically pulled apart.

In various embodiments, the snubber works by mitigating shock and vibrations travelling through the drill collar into the MWD tool string that contains sondes (the individual building blocks of an MWD tool string that typically contain electronics and sensors and/or batteries). Installing a snubber in each sonde adjacent to susceptible components can significantly reduce physical agitation in this area. Such a snubber is intended to help mitigate equipment failure caused by shock and vibration damage and to reduce costly disruptions in operations and equipment repairs.

Embodiments can also provide snubber designs for mitigating the shock and vibrations that may occur simultaneously along both torsional (rotational) and axial directions of the tool string, or that may occur only along one of the rotational and axial directions, for example at random times. The elastomer disposed within the snubber can be used to mitigate the shock and vibrations.

Figure 1B:
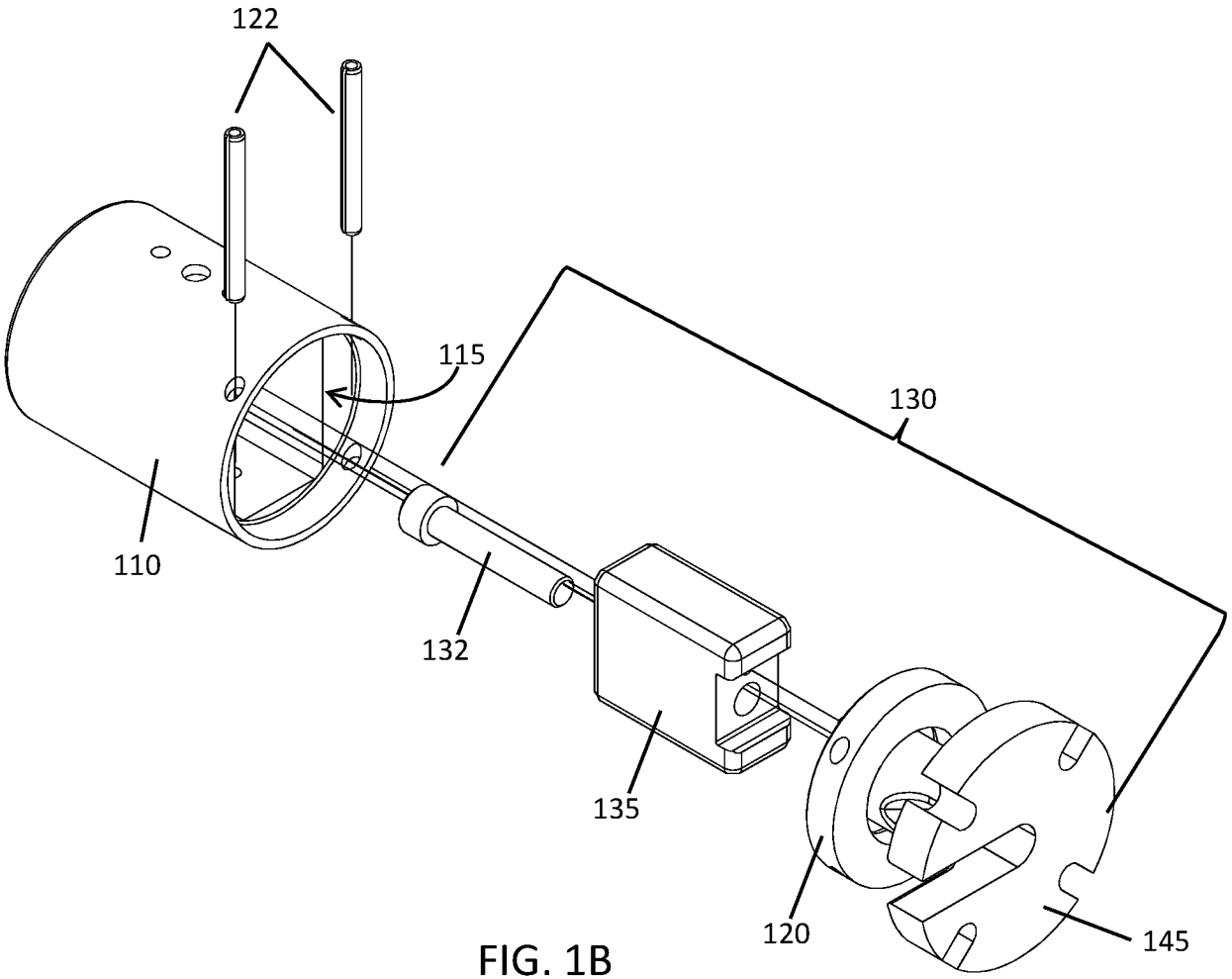

FIGS. 1A and 1B illustrate, from different perspectives, an exploded view of a snubber provided in accordance with one embodiment. The snubber includes a body 110 including a cavity 115. The body 110 may include a first mounting portion 510A, 510B (see FIGS. 5A and 5B) that is configured for connecting the device to another apparatus, such as a downhole tool or portion thereof. The snubber also includes an insert 130 having a projecting portion 135 (also referred to as an anti-rotation block) and a shaft 140 that connects at a first end to the projecting portion. The insert may also include a second mounting portion 145 that connects to a second end of the shaft 140. The second mounting portion 145 is configured for connecting the device to another apparatus, such as a downhole tool or portion thereof.

In the embodiment of FIGS. 1A and 1B, a bolt 132 is provided for connecting the projecting portion 135 to the shaft 140. The bolt may be replaced with a different connection means, such as a screw. The bolt 132 extends axially through the projecting portion into a corresponding female screw thread in the shaft. As such, the projecting portion 135 and the shaft 140 are initially provided as separate pieces, which are subsequently connected together. This allows for fitting of a cap portion 120 onto the shaft 140 prior to affixing the projecting portion 135 to the shaft 140. The cap portion 120 has an opening 124 sized to accommodate the shaft in a spaced-apart configuration with the cap portion. The cap portion 120 may be ring-shaped.

Upon assembly, the cap portion 120 is affixed to the body 110, for example using spring roll pins 122 that extend radially through corresponding slots in the main body and the cap portion. Protruding parts of the spring roll pins 122 can be removed, for example by grinding, following assembly.

The opening of the cap is sized to inhibit passage of the projecting portion through the opening. As such, after affixing the cap portion 120 to the body 110, the cap portion (which may be considered now part of the body 110), inhibits removal of the projecting portion from the cavity, thus preventing pull-apart of the snubber.

Figure 2B:
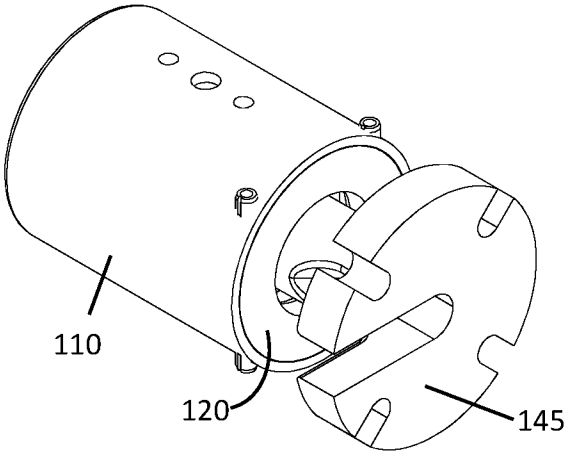
FIGS. 2A and 2B illustrate perspective views the snubber of FIGS. 1A to 1B in assembled form.
Figure 2A:
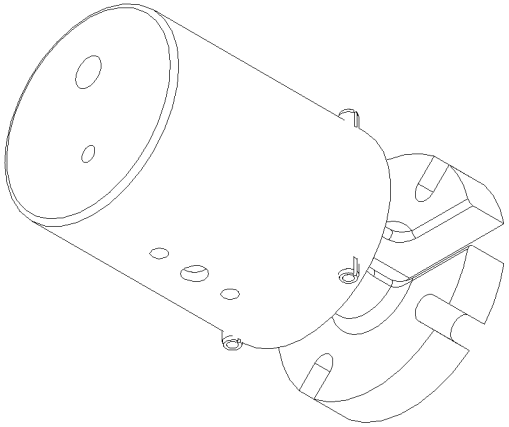

FIGS. 2A and 2B illustrate various perspective views of the snubber of FIGS. 1A to 1B in assembled form. Upon assembly, the projecting portion 135 and a first portion of the shaft 140 are located within the cavity. The insert in general includes a first part located within the cavity and a second part located outside the cavity. The first part of the insert can correspond to the projecting portion 135 and a first portion of the shaft 140. The projecting portion and the shaft in particular are spaced apart from the internal surface of the body to define a gap 150.

Figure 3A:
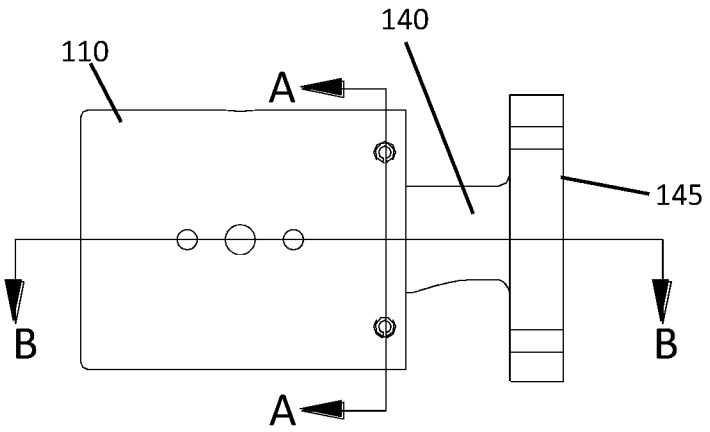
FIG. 3A illustrates a front view of the snubber of FIGS. 2A to 2B.
Figure 3C:
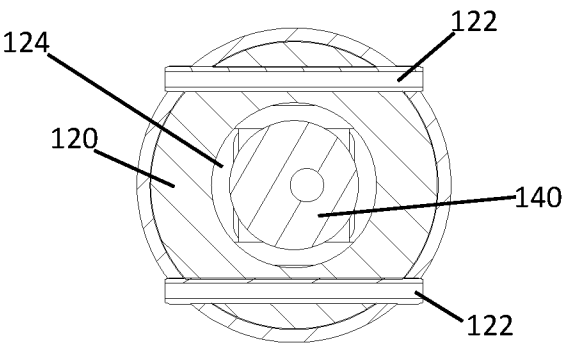
FIG. 3C illustrates a sectional view of FIG. 3A along A-A.
Figure 3B:
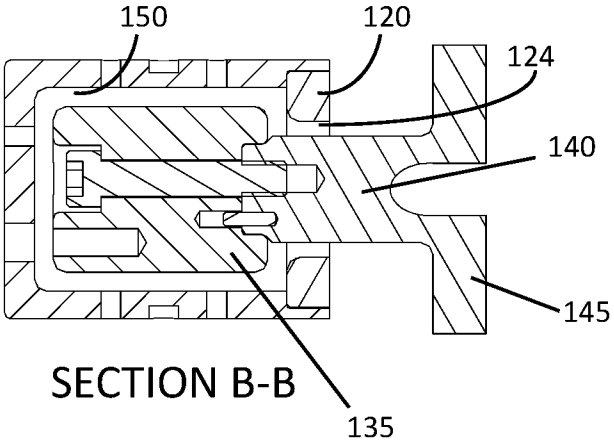
FIG. 3B illustrates a sectional view along B-B of FIG. 3A.
Figure 3D:
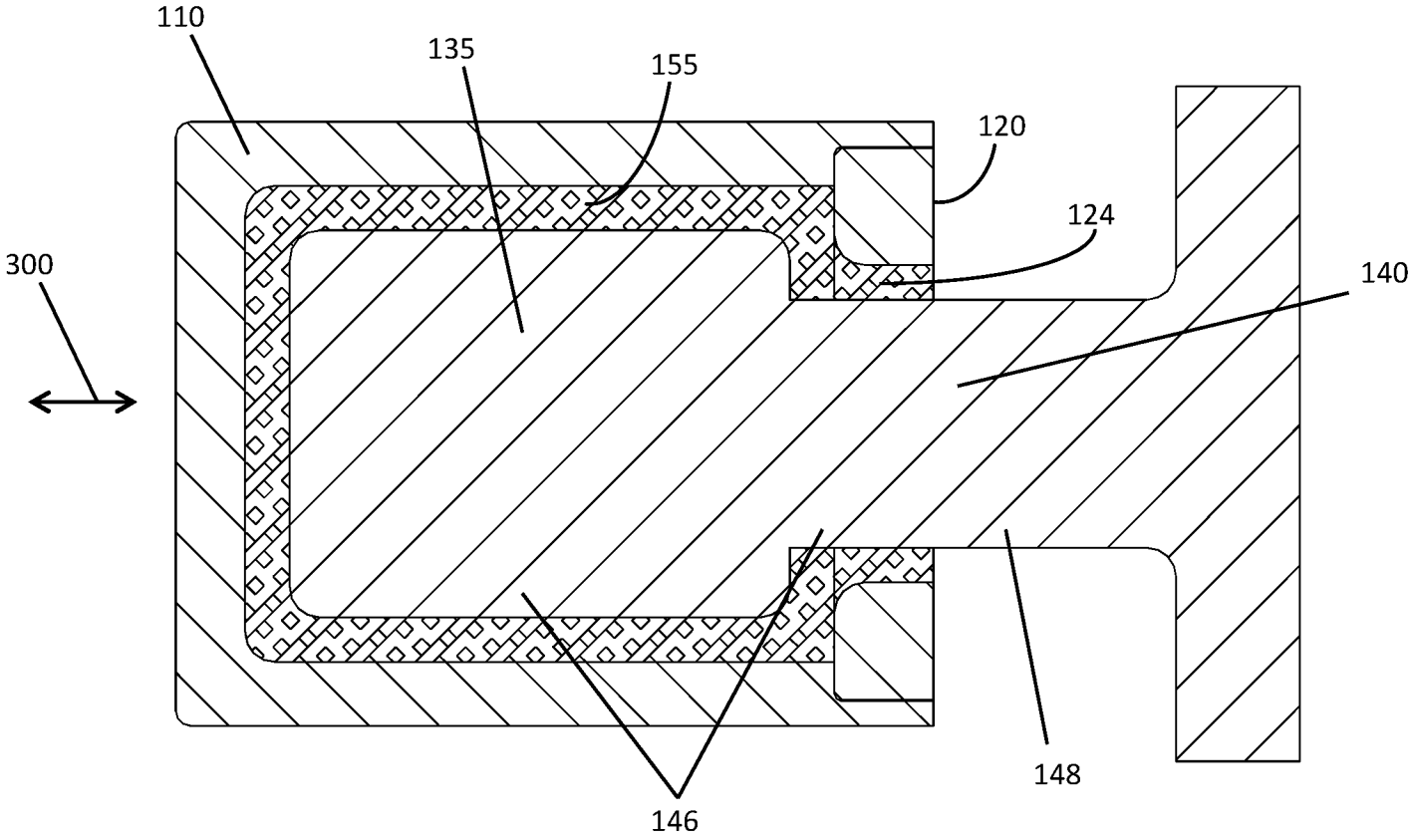
FIG. 3D illustrates a sectional view of FIG. 3A showing an elastomer filled within a gap between two main components of the snubber.

FIGS. 3A to 3D illustrate different views of the snubber of FIGS. 2A to 2B. FIG. 3B shows a sectional view of the snubber of FIGS. 2A to 2B before filling the gap 150 with an elastomer. FIG. 3D shows a sectional view of the snubber of FIGS. 2A to 2B, wherein an elastomer 155 is disposed within the gap 150, so as to surround and contact the first part 146 of the insert and the internal surface walls of the body defining the cavity. In this embodiment, the first part 146 corresponds to the projecting portion 135 and a first portion of the shaft 140. The second part 148 corresponds to the remaining portion of the shaft 140, namely the portion of the shaft 140 that is located outside the cavity. The elastomer may extend into the opening 124 of the cap portion 120 and contact the sidewalls of the opening 124.

Figure 4B:
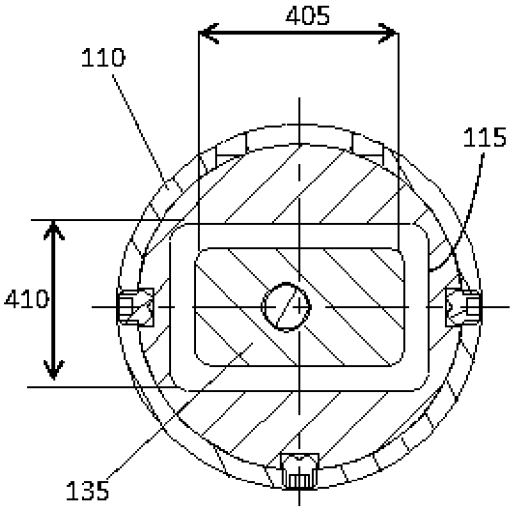
FIG. 4B illustrates a sectional view of FIG. 4A along A-A.
Figure 4A:
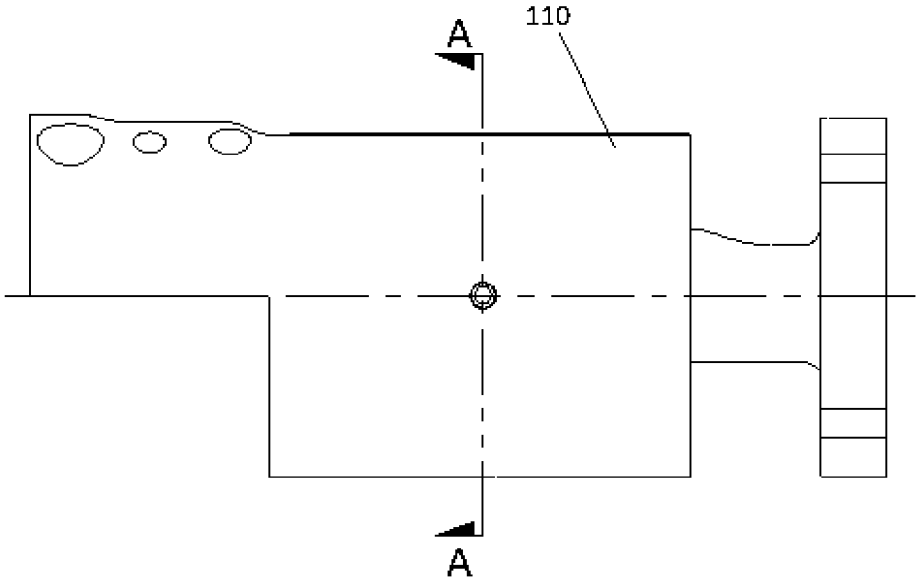
FIG. 4A illustrates a front view of another exemplary embodiment of the snubber of the present invention.

FIGS. 4A to 4B illustrate different views of another embodiment of the snubber, with FIG. 4B taken at cross-section A-A that is perpendicular to a longitudinal axis 300 of the snubber. The sidewalls of the cavity 115, in which the elastomer 155 and projecting portion 135 are disposed, has a substantially rectangular cross-sectional shape (possibly with rounded corners). The projecting portion 135 also has a substantially rectangular cross-sectional shape but with smaller length and width than the cavity 115. Other non-circular cross-sectional shapes, such as squares, polygons, ellipses, etc., may also be used. In the illustrated embodiment, the sides of the projecting portion 135 and the cavity 115 are parallel to the longitudinal axis 300.

The illustrated arrangement serves to inhibit relative rotation of the body and the insert of the snubber, for example upon complete failure of the elastomer. To achieve this, the projecting portion 135 has a dimension 405 (in a direction perpendicular to the longitudinal axis), that is larger than a narrowest width 410 of the cavity 115, thereby inhibiting rotation of the projecting portion within the cavity. That is, upon failure of the elastomer, the projecting portion 135 can begin to rotate within the cavity, but corners thereof will contact the sidewalls of the cavity, thereby inhibiting an unlimited amount of rotational displacement.

The rotation is restricted to an angle of less than 180 degrees in general, and typically to a significantly smaller angle. The restriction angle depends on the shapes and dimensions of the projecting portion 135 and the cavity 115. For example, in one embodiment, the rotation is restricted to an angle of approximately 17 degrees or less upon complete failure of the elastomer.

In one embodiment, the outer surface of the insert portion and/or the inner surface of walls of the body of the snubber are roughened or textured, for example via shot peening or sand blasting, to facilitate bonding of the elastomer to the surfaces In one embodiment, the projecting member, the body, and the cap portion are cooperatively configured to limit the axial displacement, for example upon complete failure of the elastomer. Such a limitation on axial displacement may be facilitated by the provision of the gap 150 having a width that is selected to limit the axial displacement to a desired amount.

The presence of the elastomer is used to mitigate shock and vibration in the direction of the longitudinal axis 300 as well as in directions that are perpendicular to the longitudinal axis 300.

Figure 5A:
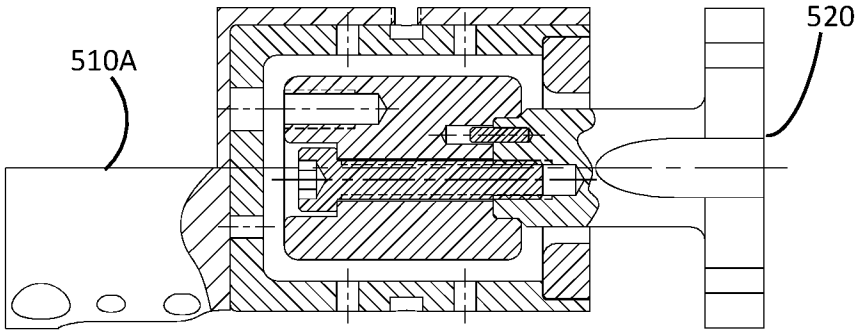
FIGS. 5A and 5B illustrate example embodiments of the snubber including variations of a first mounting portion thereof, in accordance with embodiments of the present invention.
Figure 5B:
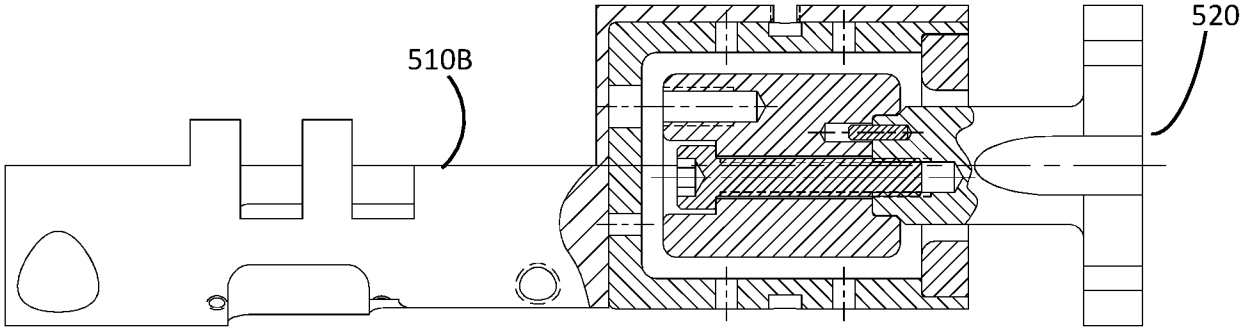

FIGS. 5A and 5B illustrate example embodiments of the snubber, particularly with different designs of a first mounting portion 510A, 510B that is configured for connecting the snubber to another apparatus, such as a sensor or chassis to which the snubber is mated. The second mounting portion 520 can be similarly configured to accommodate a sensor, chassis or other equipment to which the snubber is mated.

Figure 6A:
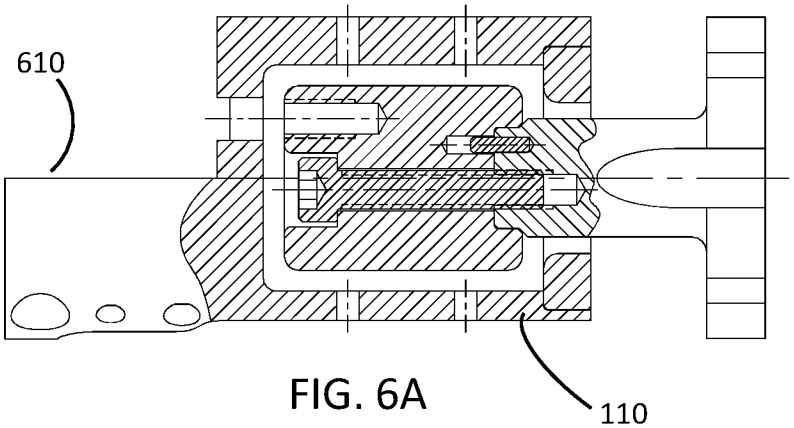
FIG. 6A illustrates an example embodiment in which the snubber being integrally formed with a first mounting portion thereof.

In one embodiment, the body portion 110 and first mounting portion 510A, 510B are made from separate pieces. In another embodiment, the snubber body portion 110 and first mounting portion 510A, 510B are integrated together. FIG. 6A illustrates an example in which the body portion 110 is integrated together with the first mounting portion 610, such that these two items are formed from a common piece of material, such as metal.

Figure 6B:
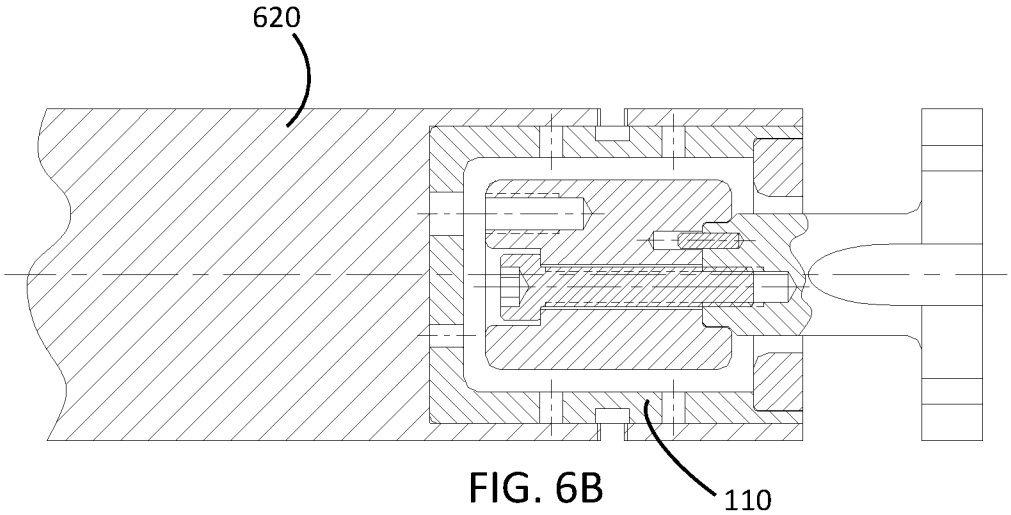
FIG. 6B illustrates an example embodiment in which the snubber is assembled into a chassis that also contains electronics and/or sensors.

FIG. 6B illustrates an example embodiment in which the snubber is assembled into a chassis that also contains electronics and/or sensors. The snubber body portion 110 is assembled directly into a chassis 620, for example by providing the snubber as a cartridge that fits within a gap of the chassis 620. The chassis 620 may be the chassis of a sonde. The chassis includes electronics, sensor components, etc.

Shock Absorber

Various embodiments can provide for a shock absorber, also referred to as a MWD dampener or shock and vibration abatement tool. The shock absorber is a mechanical device designed to absorb and dampen shock and vibration. The shock absorber may be coupled adjacent to a sonde package of the downhole tools. The shock absorber may be located proximate to an anchor point of a measurement while drilling assembly located within a drill collar of the downhole tools.

As with the snubber, the use of a compliant material integral to the design of the device is used to break up and diminish potentially damaging shock and vibration. The design is intended to reduce the amplitude and amount of shock and vibration that can be transmitted axially across the shock absorber.

Figure 7:
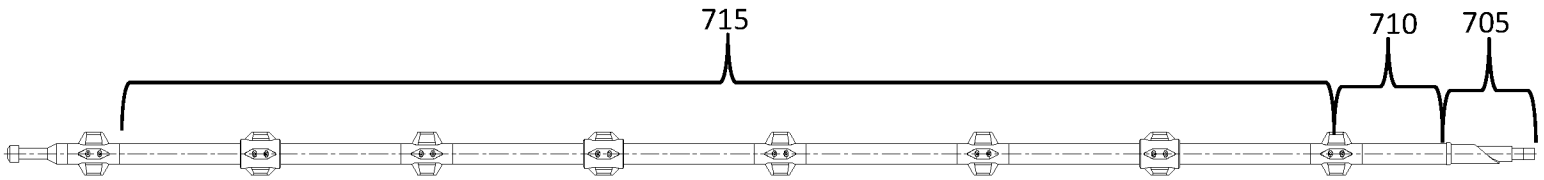
FIG. 7 illustrates the location of a shock absorber in a drill string, in accordance with embodiments of the present invention.

In various embodiments, and having reference to FIG. 7, the shock absorber 710 is located between the helix plenum 705 and the MWD tool string 715 and is configured to inhibit damaging shock and vibration from travelling through the drill collar, into the anchor (e.g. muleshoe and helix plenum 705), and then into the MWD tool string 715 where sensitive electronics and sensors are located. Various embodiments are designed to operate in this manner when installed between the helix plenum and the control valve in the pulser unit (or at any location between the MWD tool string and the anchor point).

As such, the shock absorber may be installed into the bottom end of the MWD assembly, for example within the pulser unit.

Figure 8:
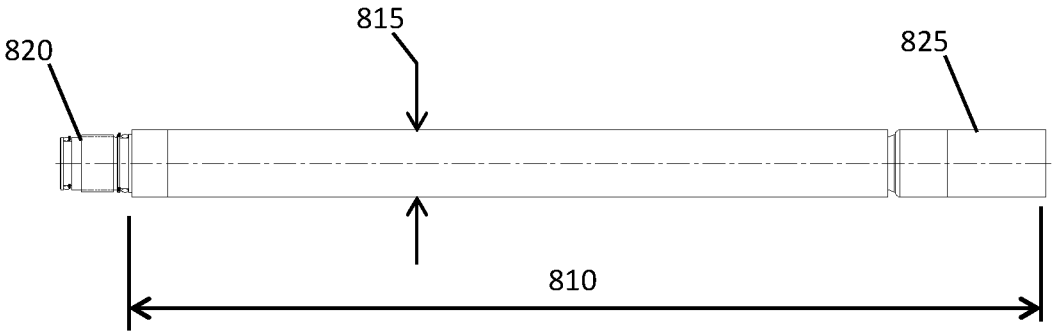
FIG. 8 illustrates an external view of a shock absorber according to an embodiment of the present invention.

FIG. 8 illustrates an external view of the shock absorber according to another embodiment, showing the diameter 815 and the effective length 810 of this tool. A pin threaded connection 820 at one end is provided for mating connection to the MWD tool string, such as the bottom of a control unit in a pulser. A box threaded connection 825 connection at the opposite end mates to, for example, the top of the helix plenum in the pulser.

In some embodiments, the shock absorber is configured to protect against one or both of rotational (torsional), and axial modes of shock and vibration. Further, the shock absorber may, when used in certain regular operating conditions, increase MTBF (Mean Time Between Failures) for the MWD tool string by helping to mitigate damage to electronics and sensors contained within the MWD. The shock absorber may be used for example in a configuration in which a downhole agitator or vibrator is used in or close to the BHA (Bottom Hole Assembly). In addition, the shock absorber may be configured, through customization of its end connections, to fit a variety of types of MWD threads and equipment.

Figure 9A:
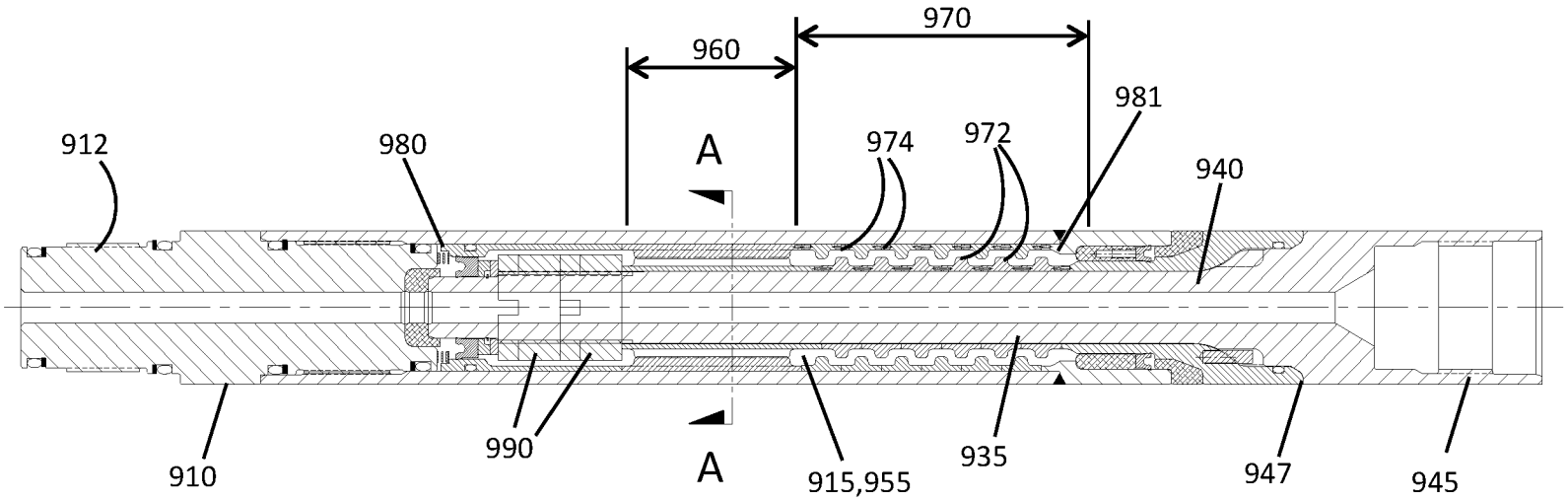
FIG. 9A illustrates a cross-sectional view of a shock absorber according to an embodiment of the present invention.
Figure 9B:
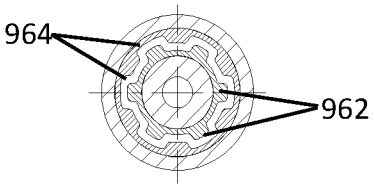
FIG. 9B is a cross-sectional view along A-A of FIG. 9A.

FIG. 9A and FIG. 9B illustrate cross-sectional views of a shock absorber according to another embodiment. The shock absorber includes a body 910 comprising a cavity 915. The body may include a pin threaded connection 912 and be configured for locating at the uphole end of the shock absorber, e.g. for connection to the MWD tool string via the connection 912. The shock absorber further includes an insert having a projecting portion 935 that is located within the cavity 915. A shaft 940 may be connected at one end to the projecting portion, and at least a first portion of the shaft may be located within the cavity 915. The shaft 940 may be connected at another end to a box threaded connection 945 for locating at the downhole end of the shock absorber and for connection to another component such as the helix plenum. Therefore, the body 910 may form an uphole portion of the shock absorber and the insert may form a downhole portion of the shock absorber. The connections 912 and 945 can be replaced with other types of connections or mounting portions, as necessary.

It is noted that the distinction between the shaft and the projecting portion is provided for clarity, however in some embodiments the shaft and the projecting portion can be regarded together as a single element, namely the projecting portion. The projecting portion 935 and the shaft 940 may correspond to a first part of the insert that is located in the cavity 915. A second part of the insert, located outside the cavity, may extend from the shoulder 947 (of the projecting portion) toward the box threaded connection 945 or similar component in place thereof.

The insert, including the projecting portion 935 and the shaft 940, is spaced apart from the internal surface of the body cavity 915 to define a gap. An elastomer 955 is disposed within the gap, such that the elastomer surrounds and contacts the projecting portion 935, the first portion of the shaft 940, and the internal surface walls of the body defining the cavity 915, thereby inhibiting direct metal-to-metal contact between the body and the insert. The projecting portion 935 can be regarded as an extension of the shaft 940. Alternatively, the projecting portion 935 can be equivalent to the shaft 940 in some embodiments.

In the illustrated embodiment, the projecting portion 935 includes a first sub-portion 960 having splines 962 oriented along the longitudinal axis of the insert. The splines 962 are aligned with corresponding longitudinal grooves 964 formed in the internal surface walls of the body defining the cavity. This detail is illustrated more clearly in FIG. 9B.

Also in the illustrated embodiment, the projecting portion 935 includes a second sub-portion 970 having ribs 972 oriented circumferentially around the projecting portion. The ribs 972 are aligned with corresponding circumferential grooves 974 formed in the internal surface walls of the body defining the cavity. In some embodiments, the relative locations of the first sub-portion 960 and the second sub-portion 970 along the longitudinal axis can be exchanged with one another.

In various embodiments, the ribs 972 and circumferential grooves 974, the splines 962 and longitudinal grooves 964, or the combination thereof, are configured to inhibit the rotation of the projecting portion within the cavity to an angle of less than 30 degrees upon failure of the elastomer. The ribs 972 and associated grooves 974 are designed to accommodate axial tension or compression and mitigate axial shock and/or vibration. The splines 962 and associated grooves 964 are designed to prevent relative rotation of the insert and body 910, and to mitigate torsional shock and/or vibration (for example resulting from stick-slip).

In some embodiments, the body includes a tubular housing with caps on opposing uphole 980 and downhole 981 ends of the housing. The caps are configured to retain one or more components of the device located within the housing during tensile loading and/or compressive loading on the device. For example, the caps may be configured to retain the components forming the longitudinal grooves 964 and the circumferential grooves 974.

In various embodiments, the projecting portion includes a shoulder 947 on a downhole end of the projecting portion and threaded retention nuts 990 on an uphole end of the projecting portion. The shoulder and the retention nuts are configured to retain one or more components of the device located within the housing during tensile loading and/or compressive loading on the device. For example, the shoulder 947 and the retention nuts may be configured to retain the ribs 972 and the splines 962.

In some embodiments, the amount of travel of the shock absorber is limited to be less than or equal to the thickness of the elastomer filling gaps between splines and ribs of the shock absorber.

Figure 10:
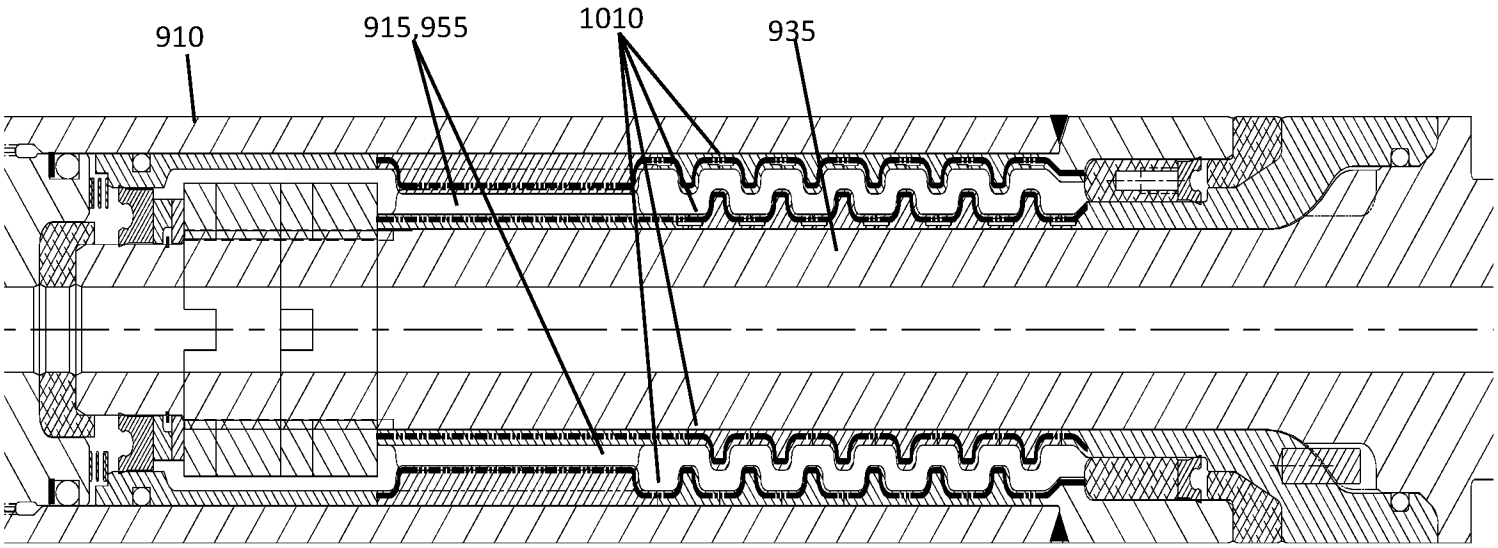
FIG. 10 illustrates an enlarged view of a portion of the shock absorber cross sectional view of FIG. 9A and FIG. 9B.

FIG. 10 illustrates an enlarged view of a portion of the shock absorber cross sectional view of FIG. 9A and FIG. 9B. Surfaces 1010 interface with the cavity 915 in which elastomer is disposed. These surfaces may be roughened or textured, for example via shot peening or sand blasting, to facilitate bonding of the elastomer to the surfaces 1010.

Figure 11A:
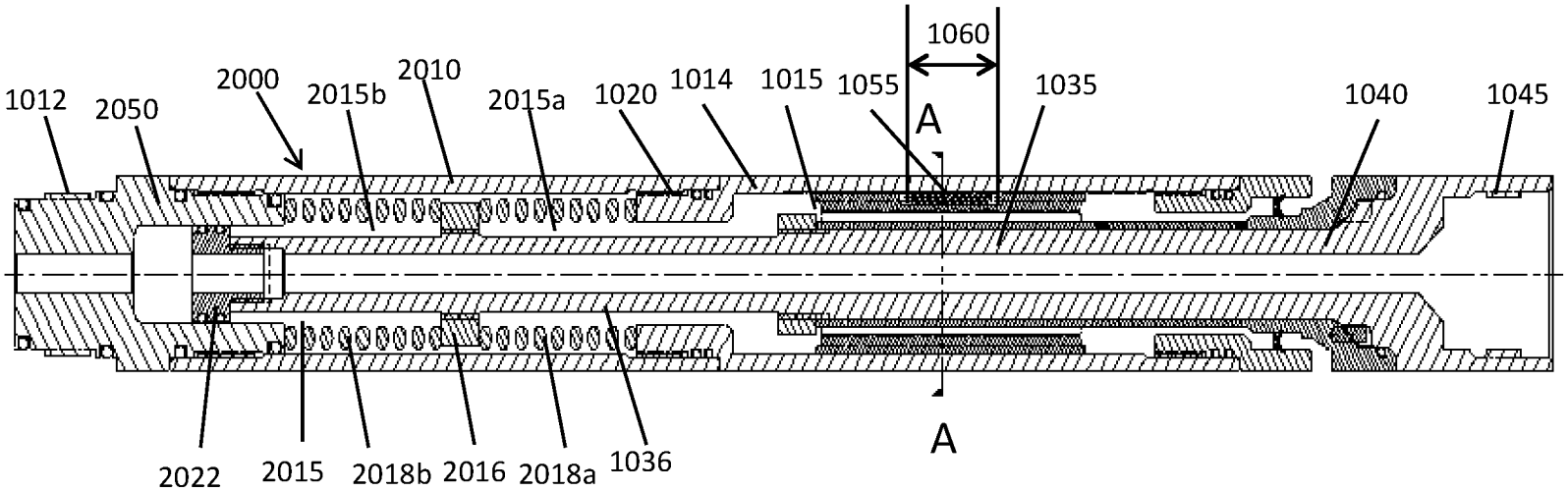
FIG. 11A illustrates a cross-sectional view of a shock absorber according to another embodiment of the present invention.
Figure 11B:
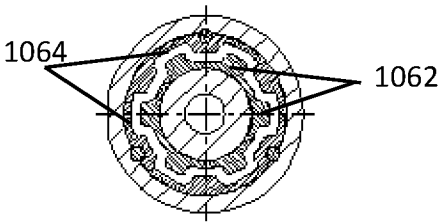
FIG. 11B illustrates a cross-sectional view along A-A of FIG. 11A.

FIGS. 11A and 11B illustrate another embodiment of a shock absorber. The shock absorber includes a body 1014 including a cavity 1015. The body includes a pin threaded connection 1020 configured for connecting to a second shock absorbing assembly 2000 for dampening axial shock and vibration.

The shock absorber further includes an insert having a projecting portion 1035 that is located within the cavity 1015. A shaft 1040 may be connected at one end to the projecting portion, or the shaft 1040 can be regarded as an extension of the projecting portion 1035. Alternatively, the projecting portion 1035 can be equivalent to the shaft 1040 in some embodiments. At least a first portion of the shaft may be located within the cavity 1015. The shaft 1040 may be connected at one end to a box threaded connection 1045 for locating at the downhole end of the shock absorber and for connection to another component such as the helix plenum. The second shock absorbing assembly 2000 is further connected to a connector 2050 that may be configured with connection 1012 for locating at the uphole end of the shock absorber, e.g. for connection to the MWD tool string via the connection 1012. The connections 1012 and 1045 can be replaced with other types of connections or mounting portions, as necessary.

The projecting portion 1035 includes a first sub-portion 1060 having splines 1062 oriented along the longitudinal axis of the insert. The splines 1062 are aligned with corresponding longitudinal grooves 1064 formed in the internal surface walls of the body defining the cavity. The detail is illustrated more clearly in FIG. 11B, which is a cross section taken along line A-A of FIG. 11A.

The insert, including the projecting portion 1035 and the shaft 1040, is spaced apart from the internal surface of the body cavity 1015 to define a gap. An elastomer 1055 is disposed within the gap, such that the elastomer surrounds and contacts a part of the insert, which includes the projecting portion 1035 and a first portion of the shaft 1040 inside of the cavity, and the internal surface walls of the body defining the cavity 1015, including the area around the splines 1062. This can inhibit or limit direct metal-to-metal contact between the body and the insert. This configuration can mitigate torsional shock and/or torsional vibration.

The second shock absorbing assembly 2000 includes a housing 2010 in connection with the body 1014. The projecting portion 1035 further includes an extension part 1036 that extends into a second cavity 2015 defined by the housing 2010 and is supported by a positioning nut 2022 inside the connector 2050. A nut 2016 is threaded on the extension part 1036 and is positioned at an approximate middle location of the extension part 1036 to separate the cavity 2015 into two cavities 2015*a* and 2015*b*. A first compression spring 2018*a* is located within the cavity 2015*a*, and a second compression spring 2018*b* is located within the cavity 2015*b*. Both the first and second compression springs 2018*a*, 2018*b* surround the extension part 1036 of the projecting portion 1035. The first compression spring 2018*a* is held between one end of the body 1014 and one end of the nut 2016, and the second compression spring 2018*b* is held between the other end of the nut 2016 and the connector 2050. The second shock absorbing assembly 2000 dampens axial shocks and/or vibrations. Namely, the first and second compression spring helps dampening axial shocks and vibrations coming from both downhole end and from uphole end.

In this embodiment, the rib configuration as shown in FIG. 10 has been eliminated and replaced by the second shock absorbing assembly to migrate the axial shocks and vibrations.

Figure 12A:
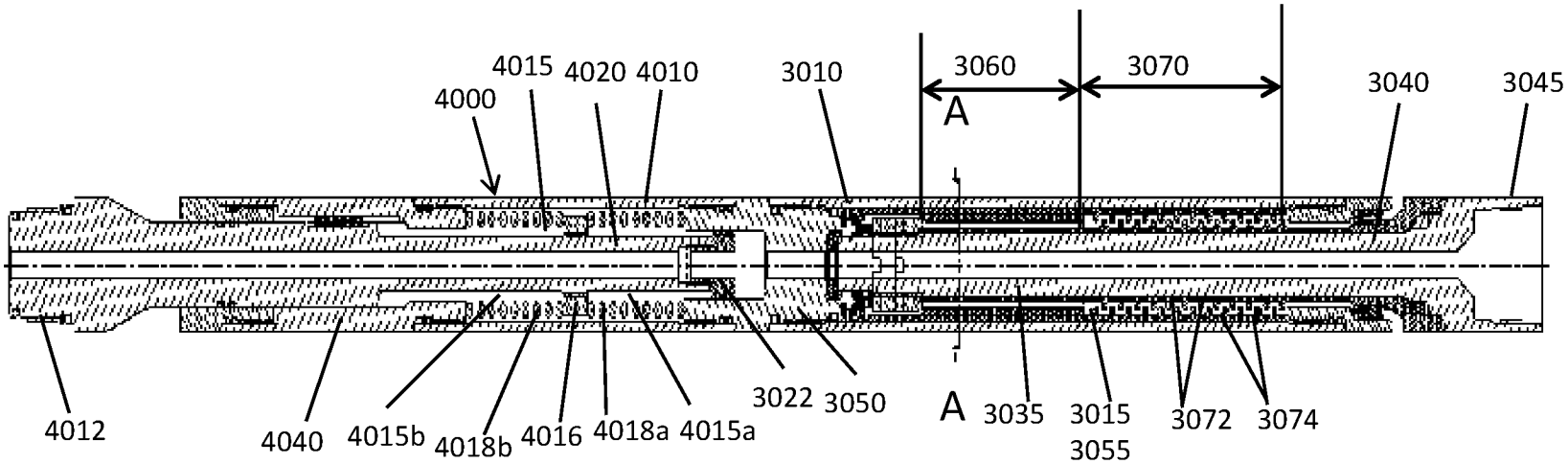
FIG. 12A illustrates a cross-sectional view of a shock absorber according to a further embodiment of the present invention.
Figure 12B:
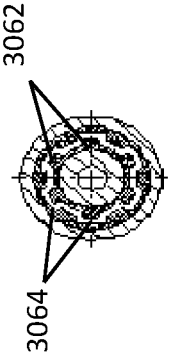
FIG. 12B illustrates a cross-sectional view along A-A of FIG. 12A.

FIGS. 12A and 12B illustrate another embodiment of a shock absorber. In this embodiment, the shock absorber includes a second shock absorbing assembly 4000 in addition to the configuration including ribs and splines as shown in FIG. 10. The shock absorber includes a body 3010 comprising a cavity 3015. The body may include a connector 3050 configured for connecting with the second shock absorbing assembly 4000.

The shock absorber includes an insert having a projecting portion 3035 that is located within the cavity 3015. A shaft 3040 may be connected at one end to the projecting portion, or the shaft 3040 can be regarded as an extension of the projecting portion 3035. The shaft 3040 may be connected at one end to a box threaded connection 3045 for locating at the downhole end of the shock absorber and for connection to another component.

The projecting portion 3035 includes a first sub-portion 3060 having splines 3062 oriented along the longitudinal axis of the insert. The splines 3062 are aligned with corresponding longitudinal grooves 3064 formed in the internal surface walls of the body defining the cavity. The detail is illustrated more clearly in FIG. 12B, which is a cross section taken along line A-A of FIG. 12A.

The projecting portion 3035 includes a second sub-portion 3070 having ribs 3072 oriented circumferentially around the projecting portion. The ribs 3072 are aligned with corresponding circumferential grooves 3074 formed in the internal surface walls of the body defining the cavity. In some embodiments, the relative locations of the first sub-portion 3060 and the second sub-portion 3070 along the longitudinal axis can be exchanged with one another.

The insert, including the projecting portion 3035 and the shaft 3040, is spaced apart from the internal surface of the body cavity 3015 to define a gap. An elastomer 3055 is disposed within the gap, such that the elastomer surrounds and contacts the projecting portion 3035, a first portion of the shaft 3040 inside of the cavity, and the internal surface walls of the body defining the cavity 3015, including the area around the splines and ribs, thereby inhibiting direct metal-to-metal contact between the body and the insert.

The second shock absorbing assembly 4000 includes a housing 4010 having a cavity 4015 and a mandrel 4020 located in the cavity. The housing 4010 is configured to connect with the body 3010 via the connector 3050. One end of the mandrel 4020 is located inside the connector 3050 and is supported by a positioning nut 3022 inside the connector 3050. The axis of the mandrel is aligned with the axis of the shaft 3040. Alternatively, the mandrel 4020 could be an extension of the shaft 3040. The other end of the mandrel 4020 is supported by a retaining member 4040 connected with the housing 4010. This end may extend to outside of the housing 4010 and the retaining member 4040, and may be configured with connections 4012 for locating at the uphole end of the shock absorber, e.g. for connection to the MWD tool string via the connection 4012.

The second shock absorbing assembly 4000 further includes a nut 4016 threaded on the mandrel 4020 and is positioned at an approximate middle location of the mandrel 4020 to separate the cavity 4015 into two cavities 4015*a* and 4015*b*. A first compression spring 4018*a* is located within the cavity 4015*a*, and a second compression spring 4018*b* is located within the cavity 4015*b*. Both the first and second compression springs surround the mandrel 4020. The first compression spring 4018*a* is held between one end of the connector 3050 and one end of the nut 4016, and the second compression spring 4018*b* is held between the other end of the nut 4016 and the retaining member 4040. The second shock absorbing assembly 4000 can further dampen extra axial shocks and/or vibrations. Namely, the first and second compression spring can further help dampen extra axial shocks and vibrations coming from both downhole end and from uphole end.

Elastomer Details

As described above, an elastomer is interposed between two portions of the device so as to be disposed within a gap between these two portions and thereby inhibit or limit metal-to-metal contact between these portions. More particularly, the elastomer is disposed within a cavity of one body and surrounding a projecting portion of an insert that is located within the cavity.

In various embodiments, the elastomer is molded within the gap between the two device portions. Molding of the elastomer may be performed by flowing the elastomer in a fluid form into the gap and hardening the elastomer in place within the gap. One or more injection holes may be provided in the device being injected in the fluid form into the cavity through the injection holes. In some embodiments, the injection holes are located in the body and communicate between an exterior of the body and the cavity of the body that contains the projecting portion of the insert.

In various embodiments, the elastomer is injected in the fluid form into an end of the body with aid of a potting fixture. The potting fixture holds the two portions of the device in place in a spaced-apart configuration, without metal-to-metal contact, so that the elastomer can be introduced into the gap. The potting fixture is removed after the elastomer hardens.

In various embodiments, the elastomer is bonded to the metal surfaces surrounding the gap in which it is disposed. Such surfaces may include the outer surface of the projecting portion and the internal surface walls of the body. The bonding of the elastomer to such surfaces allows the elastomer to act to inhibit relative motion, such as rotation, between the two metallic portions of the device. These surfaces may be textured or roughened prior to introduction of the elastomer, so as to improve bonding strength of the elastomer.

The elastomer may be one or a combination of various materials, such as rubber, synthetic rubber, synthetic rubber copolymer, urethane and/or silicone. In some embodiments, the elastomer comprises, consists, or consists essentially of silicone. An elastomeric material may be selected from one of several available materials known in the art. Selection criteria can include: initial flow-ability to facilitate molding; initial flow-ability under desirable conditions, such as room temperature conditions; bonding strength; shock and vibration dampening capability; and resistance to deterioration and/or de-bonding under nominal operating conditions, such as high-temperature (e.g. 200 degrees Celsius) conditions. In one exemplary embodiment, silicone material is a liquid silicone rubber material.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope.

What is claimed is:

1. A device for mitigating shock and vibration in downhole tools, the device comprising:

a body including a cavity;

an insert having a first part located within the cavity and a second part located outside the cavity, the insert being spaced apart from the internal surface of the body to define a gap therebetween; and an elastomer disposed within the gap such that the elastomer surrounds and bonded to the outer surface of the first part of the insert and the internal surface walls of the body defining the cavity, the elastomer being configured to inhibit direct metal-to-metal contact between the body and the insert.

2. The device of claim 1, where the elastomer is molded within the gap.

3. The device of claim 1, where the elastomer is configured to be molded by flowing the elastomer in a fluid form into the cavity and hardening the elastomer in the gap.

4. The device of claim 1, wherein the insert comprises a projecting portion and a shaft connected with the projecting portion, and the first part of the insert includes the projecting portion and a first portion of the shaft.

5. The device of claim 4, wherein the cavity and the projecting portion have non-circular cross sections, the cross sections taken along a plane that is perpendicular to a longitudinal axis of the device.

6. The device of claim 5, wherein the cross section of the cavity is rectangular, and the cross section of the projecting portion is rectangular or square.

7. The device of claim 6, wherein the projecting portion has a dimension in a direction perpendicular to the longitudinal axis that is larger than a narrowest width of the cavity and configured to inhibit rotation of the projecting portion within the cavity to an angle of less than about 17 degrees upon complete failure of the elastomer.

8. The device of claim 4, wherein the body has a main portion defining the cavity, and the body has a cap portion that is attached to the main portion and has an opening sized to accommodate the shaft in a spaced-apart configuration with the cap portion, the opening sized to inhibit passage of the projecting portion through the opening.

9. The device of claim 8, wherein the projecting portion, the body, and the cap portion are cooperatively configured to limit axial displacement of the insert relative to the body upon complete failure of the elastomer.

10. The device of claim 1, wherein the device is configured to be coupled to an electronic device or sensor within a sonde of a measurement while drilling (MWD) assembly of the downhole tools.

11. The device of claim 1, wherein the device is a snubber.

12. The device of claim 1, wherein the first part of the insert includes a projecting portion comprising a first sub-portion having splines oriented along the longitudinal axis of the at least a portion of the projecting portion, the splines are aligned with corresponding longitudinal grooves formed in the internal surface walls of the body defining the cavity, with the elastomer disposed between the splines and the corresponding longitudinal grooves and configured to absorb torsional shock and/or vibration.

13. The device of claim 12, wherein the projecting portion includes a second sub-portion having ribs oriented circumferentially around the projecting portion, the ribs being aligned with corresponding circumferential grooves formed in the internal surface walls of the body, with the elastomer disposed between the ribs and the corresponding circumferential grooves and configured to absorb axial shock and/or vibration.

14. The device of claim 13, wherein the ribs and circumferential grooves, and the splines and longitudinal grooves are cooperatively configured to inhibit rotation of the projecting portion within the cavity to an angle of less than about 30 degrees upon failure of the elastomer.

15. The device of claim 14, wherein the body includes a tubular housing with caps on opposing uphole and downhole ends of the housing, the caps configured to retain one or more components of the device located within the housing during tensile loading and/or compressive loading on the device.

16. The device of claim 13, wherein the ribs and circumferential grooves, and the splines and longitudinal grooves are cooperatively configured to limit axial displacement of the insert relative to the body upon complete failure of the elastomer.

17. The device of claim 13 further comprising:

a second shock absorbing assembly having a housing connected with the body and at least one compression spring within the housing and surrounding a mandrel located in the housing;

a nut threaded on the mandrel to separate the housing into a first cavity and a second cavity; and a first compression spring located in the first cavity and a second compression spring located in the second cavity.

18. The device of claim 12, wherein the projecting portion includes a shoulder on a downhole end of the projecting portion and threaded retention nuts on an uphole end of the projecting portion, the shoulder and the retention nuts being configured to retain the one or more components of the device located within the housing during tensile loading and/or compressive loading on the device.

19. The device of claim 12, wherein the device is a shock absorber.

20. The device of claim 19, wherein the body forms an uphole portion of the shock absorber and the insert forms a downhole portion of the shock absorber.

21. The device of claim 1, wherein the first part of the insert includes a projecting portion including a sub-portion with ribs oriented circumferentially around the projecting portion, the ribs being aligned with corresponding circumferential grooves formed in the internal surface walls of the body, with the elastomer disposed between the ribs and the corresponding circumferential grooves and configured to absorb axial shock and/or vibration.

22. The device of claim 1, wherein the elastomer includes rubber, synthetic rubber, synthetic rubber copolymer, urethane and/or silicone.

23. The device of claim 1, wherein the device is configured to mitigate one or more of torsional shock, torsional vibration, axial shock, and axial vibration.

24. A measurement while drilling (MWD) assembly comprising one or both of: at least one snubber and at least one shock absorber; the at least one snubber being contained within sondes of the MWD assembly; the at least one shock absorber contained within the MWD assembly;

wherein the at least one snubber comprises:

a body comprising a cavity;

an insert having a first part located within the cavity and a second part located outside the cavity, the insert being spaced apart from the internal surface of the body to define a gap there between; and an elastomer disposed within said gap, such that the elastomer surrounds and contacts the first part of the insert and the internal surface walls of the body defining the cavity, thereby inhibiting direct metal-to-metal contact between the body and the insert;

wherein the at least one shock absorber comprises:

a second body comprising a cavity;

a second insert having another first part located within the cavity and another second part located outside the cavity, the second insert being spaced apart from the internal surface of the second body to define a second gap there between; and a second elastomer disposed within said second gap, such that the second elastomer surrounds and contacts the first part of the second insert and the internal surface walls of the second body defining the cavity, thereby inhibiting direct metal-to-metal contact between the second body and the second insert;

wherein the first part of the second insert includes a projecting portion comprising a first sub-portion having splines oriented along the longitudinal axis of the at least a portion of the projecting portion, the splines being aligned with corresponding longitudinal grooves formed in the internal surface walls of the second body defining the cavity, with the second elastomer disposed between the splines and the corresponding longitudinal grooves for absorbing torsional shock and/or vibration;

the projecting portion further comprising a second sub-portion having ribs oriented circumferentially around the projecting portion, the ribs being aligned with corresponding circumferential grooves formed in the internal surface walls of the second body, with the elastomer disposed between the ribs and the corresponding circumferential grooves for absorbing axial shock and/or vibration.

25. The assembly of claim 24, wherein the first elastomer surrounds and is bonded to the outer surface of the first part of the first insert and to the internal surface walls of the first body, and the second elastomer surrounds and is bonded to the outer surface of the first part of the second insert and to the internal surface walls of the second body.

* * * * *